US006030282A

United States Patent [19]

Mahanpour

[11] Patent Number: 6,030,282

[45] Date of Patent: Feb. 29, 2000

[54] METHOD AND APPARATUS FOR HOLDING, GRINDING AND POLISHING A PACKAGED SEMICONDUCTOR DIE

[75] Inventor: Mehrdad Mahanpour, Union City, Calif.

[73] Assignee: Advanced Micro Devices, Inc., Sunnyvale, Calif.

[21] Appl. No.: 09/103,045

[22] Filed: Jun. 23, 1998

[51] Int. Cl.[7] ..... B24B 41/00

[52] U.S. Cl. ..... 451/364

[58] Field of Search ..... 451/386, 391, 451/364; 269/903, 289, 296

[56] References Cited

U.S. PATENT DOCUMENTS 3,996,659 12/1976 Gaicki et al. ..... 29/590

5,340,011 8/1994 Sanchez ..... 228/4.5

5,786,632 7/1998 Farnworth et al. ..... 257/701

*Primary Examiner*—Joseph J. Hail, III

*Assistant Examiner*—William Hong

*Attorney, Agent, or Firm*—Sawyer & Associates

[57] ABSTRACT

A method and apparatus for holding, grinding and polishing a die include a platform (10), a boss (20) on the platform, and a shielding structure (30) attached to at least one of the platform (10) and the boss (20). The boss (20) is configured for supporting a packaged (42) die (41) to be ground and polished and has a supporting topography to accommodate at least one package and lead configuration. The shielding structure (30) is configured to protect such a packaged (42) die (41) from physical and electrical damage when supported on the boss (20).

10 Claims, 3 Drawing Sheets

METHOD AND APPARATUS FOR HOLDING, GRINDING AND POLISHING A PACKAGED SEMICONDUCTOR DIE

BACKGROUND OF THE INVENTION

The present invention relates to methods and tools used in failure analysis of integrated circuit (IC) products in the semiconductor industry, and more particularly to a method of mechanically grinding and polishing a packaged semiconductor die (also called an IC chip) in a manner that protects the die from electrical and physical damage, and an apparatus for carrying out the method.

IC circuits fail due to various electrical, physical, or chemical mechanisms such as electrical overstress, wear out, or contamination. Some failure analysis approaches and procedures require a die substrate to be precisely ground down to a particular thickness, then polished, in order to implement certain tests such as infrared or emission microscope analysis to locate such mechanisms. The most well known method of mechanically grinding and polishing a die involves progressively grinding the die or chip down to a desired thickness using a die holder, an abrasive, and a rotatable wheel, and then polishing the die substrate surface. For both grinding and polishing, the die holder applies the die to the abrasive, which is attached to the rotatable wheel.

The die holders currently used are often problematic in their implementation. The conventional and most popular method of using such a holder consists of essentially three steps. First, the user by conventional means exposes a die to be ground and polished. Second, the user secures the device (die and die package) to the holder. Third, the user applies the die to an abrasive, which is supported by a rotatable wheel.

The disadvantage of the conventional method is that the device is likely to lose functionality, which would end the analysis of the device. This typically occurs for several reasons. First, because the user handles the holder by hand, electrostatic discharge from the user's fingers to the holder and device can damage the device. Second, physical damage from the user's fingers inadvertently bending the device leads can be problematic. Third, adhesive wax used to attach the device to the holder builds up between the device leads, removal of which is tedious and time consuming. The prior art has not adequately addressed these concerns and has therefore fallen short of producing desired and reliable results.

Known methods of preventing such electrical and physical damage or of eliminating the prior art wax problem are inadequate to present technological needs. A need therefore remains for a mechanical die grinding and polishing method and apparatus that preserves the functionality of the device when grinding and polishing a die.

SUMMARY OF THE INVENTION

The present invention meets the above needs with a new and improved method of grinding and polishing a die while preserving its functionality, and a new and improved die holder therefor in which the geometry is such that it preserves the die's functionality.

In the preferred embodiment, the die holder includes a platform, a boss, and a shielding structure. The platform supports the boss and shielding structure; both are attached to the platform. The boss supports a packaged die to be ground and polished.

The shielding structure protects such a packaged die or device from electrical and physical damage when the device is supported on the boss. The shielding structure substantially surrounds the sides of the device. This allows the user to grasp the holder without making contact with the device.

The device is attached to the die holder with an adhesive wax. The wax connects the boss to the package surface of the device rather than to the device leads. This is possible because the boss is configured to contact the package without contacting the leads. Because the adhesive wax makes contact with only a small surface area on the die package, removing the device from the holder after it is ground and polished is quick and simple. The user simply raps the edge of the die package, which releases the device from the holder. In the prior art the adhesive wax contacts the package leads, so the wax needs to be heated to release the device from the holder. This is messy and adds time to the entire process. The present invention eliminates this problem.

The present invention preserves the device functionality by protecting the device from electrical and physical damage and by protecting the leads from the adhesive wax. The exact dimensions, of course, will depend upon the actual package and lead configurations. The end result is a desired functional die that is ground and polished on a consistent, reliable, and easily produced basis.

It is therefore a benefit of the present invention to provide a new and improved method and apparatus for grinding and polishing packaged semiconductor dies; wherein the die holder includes, a platform, a boss on the platform configured for supporting a packaged die to be ground and polished, and a shielding structure attached to at least one of the platform and the boss and configured to protect such a die from physical and electrical damage when supported on the boss; in which the boss has a supporting topography to accommodate at least one package and lead configuration; in which the supporting topography may be flat; in which the supporting topography may have a grid-like configuration, annular configuration, or a bed-of-nails configuration; in which the shielding structure may further include shielding grasps; in which the shielding grasps may be located on opposite sides of the boss; in which the shielding structure may be a wall substantially surrounding the sides of such a packaged die when the die is supported on the boss; and to accomplish the above benefits and purposes in an inexpensive, uncomplicated, durable, versatile, and reliable method and apparatus, inexpensive to manufacture, and readily suited to the widest possible utilization.

These and other features and advantages of the invention will be apparent from the following description, the accompanying drawings, and the appended claims.

BRIEF DESCRIPTION OF THE DRAWINGS

Certain embodiments of the present invention are described, reference being made to the accompanying drawings, wherein.

DESCRIPTION OF THE PREFERRED EMBODIMENT

With reference to the drawings, the new and improved method for holding, grinding and polishing a semiconductor die, and the apparatus for carrying out the method according to the present invention, will now be described.

Figure 1:
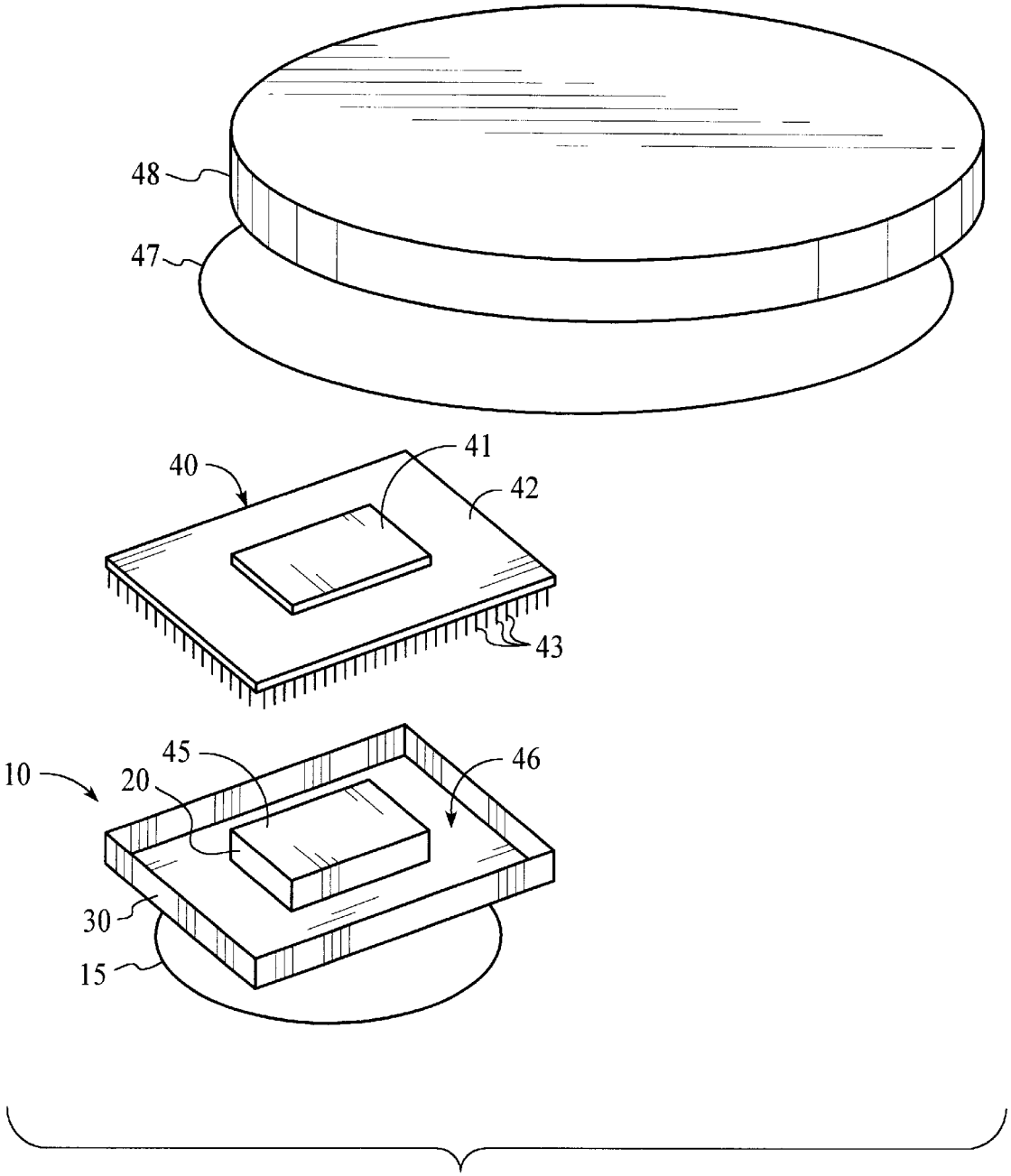
FIG. 1 is an exploded perspective view of an embodiment of the present invention and components typically associated therewith.

FIG. 1 shows a perspective view of the preferred embodiment of the holder 10 of the present invention. Holder 10 includes a platform 15 having two threaded mount screw holes 18 therein (FIG. 2) opening through the bottom face of the platform 15. On its top face, platform 15 supports a boss 20 and a shielding structure 30, both of which are attached directly to the platform 16.

Figure 2:
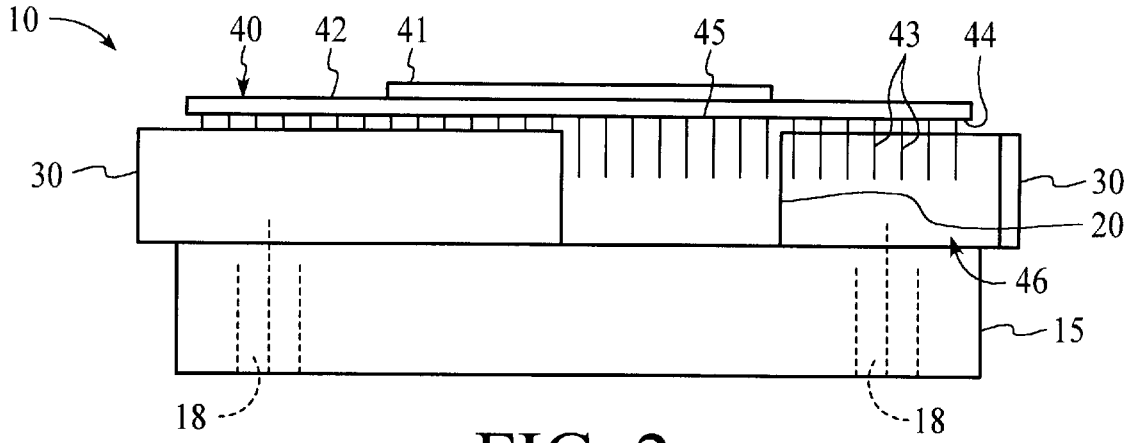
FIG. 2 is a partial cross-sectional side view taken generally on line 2—2 in FIG. 3.
Figure 3:
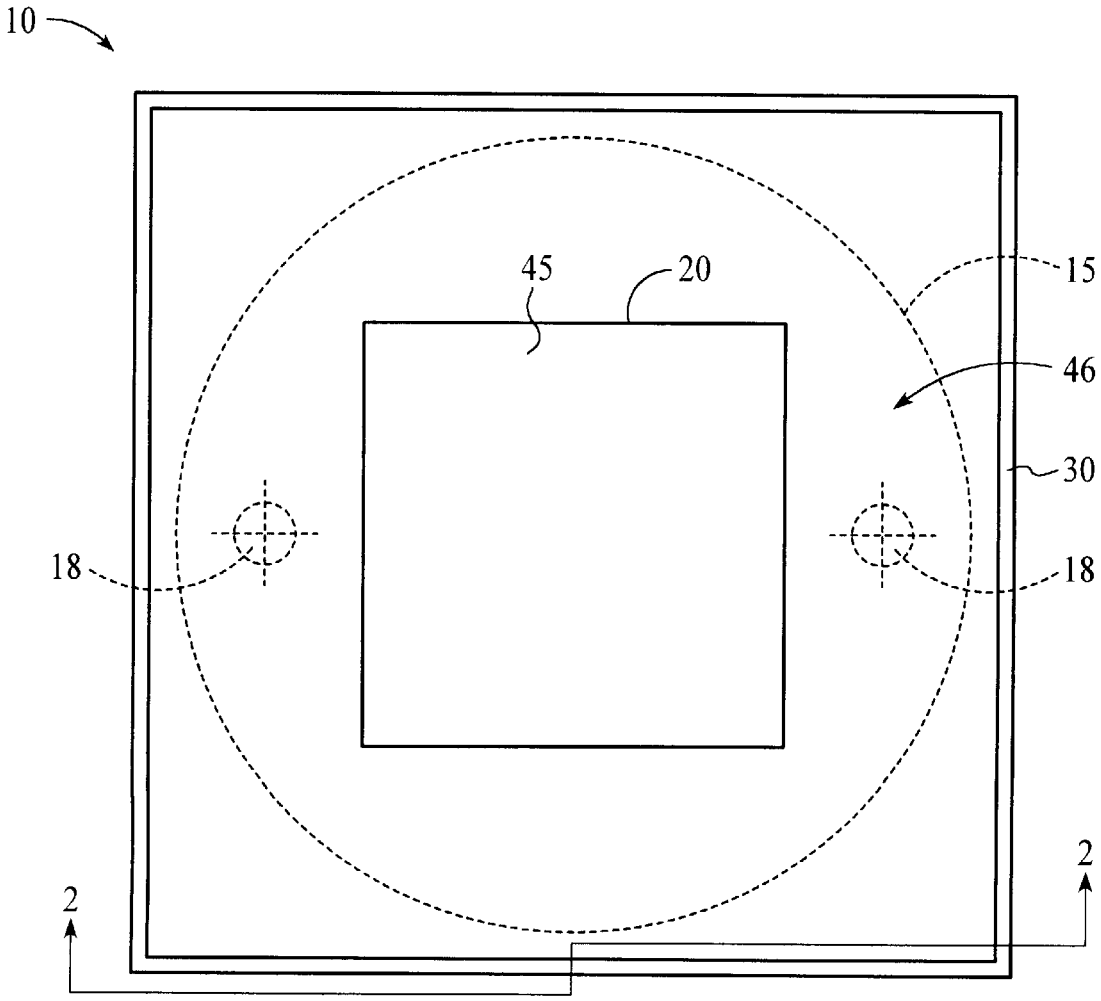
FIG. 3 is a top view of the holder embodiment shown in FIG. 1.
Figure 4:
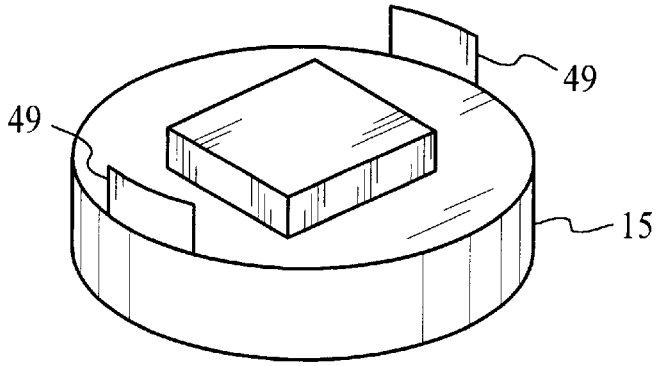
FIG. 4 is a perspective view of the holder embodiment shown in FIG. 1 with an alternative shielding structure embodiment.
Figure 5:
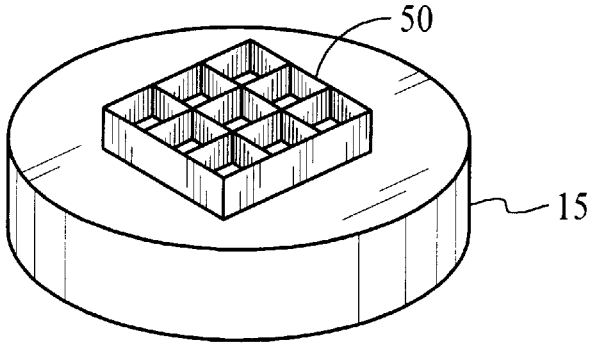
FIGS. 5 to 7 are perspective views of the holder embodiment shown in FIG. 1 with alternative boss embodiments.
Figure 6:
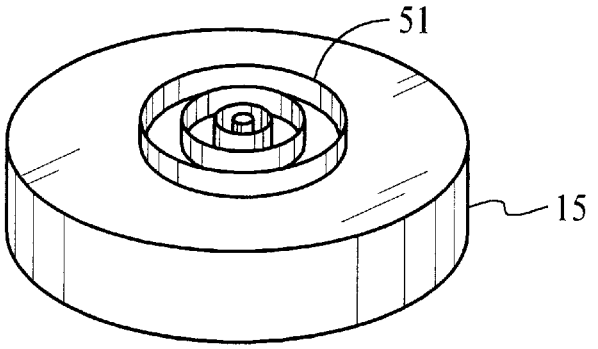

FIG. 2 shows a partial cross-sectional side view of the holder 10 taken generally on line 2—2 in FIG. 3. A semiconductor device 40 (die 41, die package 42, and device leads 43) is attached on its bottom surface 44 to the top 45 of the boss 20. A space 46 between the boss 20 and the shielding structure 30 allows the user to position the device leads 43 therebetween. The boss 20 is elevated enough (FIG. 2) to provide for sufficient lead clearance above platform 15. Space 46 at the base of boss 20 also creates a gutter for deterring wax build up; this prevents wax from building up into the leads 43 which would render the device 40 non-functional.

In this embodiment, the boss 20 supports a pin-grid-array package and lead configuration such as the square package shown in FIG. 2. The shielding structure 30 forms a wall which protects the die or device from physical and electrical damage. It does so by preventing the user's fingers from contacting the device leads 43. Such contact can physically damage the device if the user were to inadvertently bend the device leads when picking up the holder. Such contact can also electrically damage the die by electrostatic discharge passing from the user. To protect against this, the structure 30 is conductive to prevent any electrostatic discharge from damaging the die.

The shielding structure 30 surrounds the device 40 and covers only the device leads 43, not the device package. This allows for the user to easily extract the device from the holder after grinding and polishing. As described above, the device is attached to the die holder with a small amount of adhesive wax between the device package and the holder. The user simply raps the edge of the die package to release the device.

In known fashion, an abrasive disk 47 (FIG. 1) grinds the die 41 substrate down to a desired thickness. A rotatable wheel 48 provides a firm and flat support for the abrasive disk 47 as the die 41 is applied by force against the abrasive disk. The abrasive disk is firm enough not to bunch up yet pliable enough such that all portions of the die 41 contact the abrasive 47 and are ground.

Figure 7:
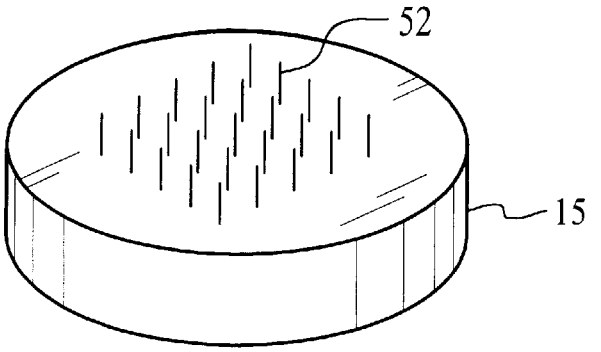

FIGS. 4 to 7 show alternative embodiments of the invention. For example, in FIG. 4 the shielding structure could be a pair of shielding grasps 49 rather than a wall. These grasps would, like the wall, prevent the user's fingers from contacting the device by diverting the user's fingers to the grasps rather than the exposed leads. The boss topography could be grid-like 50 (FIG. 5), annular 51 (FIG. 6), or a bed of nails 52 (FIG. 7). Such a variety of topographies would allow the holder to support a variety of package and lead configurations. (For clarity of illustration, the shielding structures have been omitted from drawing FIGS. 5 to 7.)

As may be seen, therefore, the present invention provides numerous advantages. Principally, it eliminates problems and limitations resulting from electrical and physical damage, and problems resulting from adhesive wax buildup, problems that the prior art has failed to resolve satisfactorily.

Therefore, while the methods and forms of apparatus herein described constitute preferred embodiments of this invention, it is to be understood that the invention is not limited to these precise methods and forms of apparatus, and that changes may be made therein without departing from the scope of the invention.

What is claimed is:

1. A packaged semiconductor die holder for a die grinding and polishing operation, comprising:

a) a platform;

b) a boss on said platform configured for supporting a packaged die to be delayered; and c) a shielding structure attached to at least one of said platform and said boss and configured to protect such a packaged die from physical and electrical damage when supported on said boss.

2. A holder as in claim 1 wherein said boss has a supporting topography to accommodate at least one package and lead configuration.

3. A holder as in claim 2 wherein said supporting topography is flat.

4. A holder as in claim 2 wherein said supporting topography has an annular configuration.

5. A holder as in claim 2 wherein said supporting topography has a grid-like configuration.

6. A holder as in claim 2 wherein said supporting topography has a bed-of-nails configuration.

7. A holder as in claim 1 wherein said shielding structure further comprises shielding grasps.

8. A holder as in claim 7 wherein said boss is located between said shielding grasps.

9. A holder as in claim 1 wherein said shielding structure is a wall substantially surrounding the sides of such a packaged die when supported on said boss.

10. A packaged semiconductor die holder for a die grinding and polishing operation, comprising:

a) a platform;

b) a boss on said platform configured for supporting a packaged die to be delayered;

c) said boss having a supporting topography to accommodate at least one package and lead configuration; and d) attached to at least one of said platform and said boss, a shielding structure which forms a wall substantially surrounding the sides of such a packaged die when supported on said boss.

* * * * *